United States Patent [19]

Moix et al.

[11] 4,172,018

[45] Oct. 23, 1979

[54] PROCESS AND DEVICE FOR THE PRODUCTION OF ALUMINUM

[75] Inventors: Hermann Moix, Vetroz, Switzerland; Alfred Sturm, Steinen-Hüsingen, Fed. Rep. of Germany

[73] Assignee: Swiss Aluminium Ltd., Chippis, Switzerland

[21] Appl. No.: 916,970

[22] Filed: Jun. 19, 1978

[30] Foreign Application Priority Data

Jun. 28, 1977 [CH] Switzerland ..... 7956/77

[51] Int. Cl.[2] ..... C25C 3/06; C25C 3/08; C25C 3/14

[52] U.S. Cl. ..... 204/67; 204/245

[58] Field of Search ..... 204/67, 243 R, 245

[56] References Cited

U.S. PATENT DOCUMENTS

| | | | |
|---|---|---|---|
| 3,186,927 | 6/1965 | Mantovanello | 204/245 |
| 3,551,308 | 12/1970 | Capitaine et al. | 204/67 |
| 3,663,411 | 5/1972 | Springer | 204/245 |
| 3,977,950 | 8/1976 | Tortil | 204/67 |

*Primary Examiner*—Howard S. Williams
*Attorney, Agent, or Firm*—Bachman and LaPointe

[57] ABSTRACT

A process and electrolytic cell are described for the production of aluminum whereby the feeding of the cell with fresh alumina, including the breaking of the crust of solidified electrolyte, is carried out in at least one space running transverse to the longitudinal axis of the cell.

16 Claims, 3 Drawing Figures

PROCESS AND DEVICE FOR THE PRODUCTION OF ALUMINUM

BACKGROUND OF THE INVENTION

The present invention relates to a process for the production of aluminum by means of electrolysis of a molten electrolyte, and also relates to an electrolytic cell for this purpose.

In order to obtain aluminum by electrolysis from aluminum oxide, this oxide is usually dissolved in a fluoride melt which consists for the most part of cryolite ($Na_3AlF_6$). The aluminum which separates out at the cathode collects on the carbon floor of the cell under the fluoride melt, whereby the surface of the liquid aluminum forms the cathode. Anodes which, in conventional processes, are made out of amorphous carbon dip into the fluoride melt from above. At the carbon anodes, due to the electrolytic decomposition of the aluminum oxide, oxygen is formed and combines with the carbon of the anode to produce CO and $CO_2$. The electrolysis takes place in a temperature range of about 940° to 975° C.

The well known principle of a conventional aluminum electrolytic reduction cell with pre-baked carbon anodes is illustrated in FIG. 1, which corresponds with the present state of the art and shows a vertical cross section longitudinally through a part of the electrolytic cell. The steel shell 12, which is lined with thermal insulation 13 of heat resistant material of low thermal conductivity and carbon 11, contains the fluoride melt 10 which constitutes the electrolyte. The aluminum 14 which precipitates out at the cathode is lying on the carbon floor 15 of the cell. The surface 16 of the liquid aluminum forms the cathode.

Embedded in the carbon lining 11, running transverse to the length of the cell, are iron cathode bars 17 which conduct the electrical direct current out of the carbon lining 11 and out of the cell at its sides.

Anodes 18 of amorphous carbon, which supply the direct current to the electrolyte, dip into the fluoride melt from above. The anodes are connected via anode rods 19 and clamps 20 to the anode beam 21.

The electrical current flows from the cathode bars 17 of one cell to the anode beam 21 of the next cell via busbars which are not shown here. It then flows from the anode beam 21 through the anode rods 19, the anodes 18, the electrolyte, the liquid aluminum 14, and the carbon lining 11 to the cathode bars 17.

The electrolyte 10 is covered with a crust 22 of solidified melt and a layer of aluminum oxide 23 on top of the crust 22. During operation of the cell there are spaces 25 between the electrolyte 10 and the solidified crust 22. There is also a crust of solidified electrolyte 24 on the side walls of the carbon lining 11. This crust of solidified electrolyte forming the lateral ledge 24 at the side walls delimits the horizontal dimensions of the bath of liquid aluminum 14 and electrolyte 10.

The distance d between the bottom face 26 of the anodes and the surface of the aluminum 16, also called the interpolar distance, can be altered by raising or lowering the anode beam 21 with the help of lifting mechanisms 27 which are mounted on the columns 28. Operating the lifting mechanism 27 raises or lowers all the anodes at the same time. The height of the anodes can also be adjusted individually by means of the clamps 20 on the anode beam 21.

As a result of the reaction with oxygen released during the electrolysis, the anodes are consumed at the bottom by about 1.5 to 2 cm per day, the amount depending on the type of cell. At the same time the surface of the liquid aluminum in the cell rises by about 1.5 to 2 cm per day. In the course of the electrolysis the electrolyte becomes depleted in aluminum oxide. At a lower concentration of 1 to 2 weight percent of aluminum oxide in the electrolyte, the so called anode effect is observed, i.e., there is a sudden increase in voltage from the normal 4–4.5 volts to a value of 30 volts and more. By then, at the latest, the crust has to be broken and new aluminum oxide added.

Under the normal mode of operation, the cell is supplied periodically with aluminum oxide, even when no anode effect occurs. In addition to that, each time the anode effect is observed, the crust must be broken and, as described above, the aluminum concentration raised by adding fresh aluminum oxide. The anode effect is, therefore, in practice always associated with cell supervision of a kind, which, in contrast to normal supervision, can be called "anode effect supervision".

The aluminum 14 which is produced as a result of the electrolysis collects on the floor 15 of the cell and is generally tapped off once daily by means of a special device, not shown.

For very many years now cell supervision has involved breaking the crust of solidified melt between the anodes and the side wall of solidified electrolyte and then adding fresh aluminum oxide. This method, which is still widely used today, is encountering increasing criticism because it is said to cause contamination of the air in the reduction plant and in the atmosphere around the plant. The pressure to have the cells sealed off and treat the waste gases has increased so much in recent years that it is now almost a compulsory measure. Proper elimination of waste gases in the plant is not possible, however, by sealing the cell if the feed of aluminum oxide has to be made along the side of the cell, between the anodes and the side wall of the cell.

In recent times, therefore, aluminum producers have been going over increasingly to central feed of the cell along its longitudinal axis. After breaking the crust, the feed of alumina takes place either locally and continuously by the point feeder system or discontinuously along the whole length of the central axis.

Years of experience with centrally fed cells have shown this method has the following disadvantages:

(a) Poor dissolution of the alumina added.
(b) Pronounced formation of sludge on the cell floor.
(c) Hard crust formation on the carbon floor along the long axis of the cathode.
(d) It becomes difficult or even impossible to form a lateral ledge of electrolyte crust at the sides of the cell.

When electrolytic cells are centrally fed, a non-insulating sludge forms first at the point of addition of alumina and can gradually transform to an electrically insulating crust. This causes irregularities in the running of the cell and can shorten its service life, in particular because of the consumption of the side walls of the carbon anodes. This consumption of the carbon is the result of movement of the melt due to magnetic stirring effects and the stirring in turn produces pronounced, localized differences in current density.

SUMMARY OF THE INVENTION

In accordance with the present invention, the inventors set themselves the task of developing a process and device for the production of aluminum by electrolysis of a molten charge whereby the above-mentioned difficulties are eliminated, optimum dissolution of the alumina added is achieved, and optimum current density is assured, at the same time taking into account economic and environmental aspects.

This object is attained by way of the present invention in that the supervision of the cell, including the breaking of the crust of solidified electrolyte and the addition of aluminum oxide, takes place in at least one space lying transverse to the longitudinal axis of the cell and between two anodes.

For this, in terms of the present invention, use is made of an electrolytic cell which is such that at least one enlarged space is provided for feeding alumina to the cell and this space lies transverse to the longitudinal axis of the cell, between two anodes in zones of active metal flow where favorable cathodic current distribution exists.

Accordingly, the process of the present invention is a process for the production of aluminum via electrolysis of a molten charge in an electrolytic cell having an electrolyte, a plurality of spaced anodes immersed therein and a cathode in contact with the electrolyte, said cell having a longitudinal axis, wherein the feeding of the cell, including the breaking of the crust of solidified electrolyte and the addition of alumina, is carried out in at least one space running transverse to the longitudinal axis of the cell between two anodes.

The cell of the present invention is an electrolytic cell for the production of aluminum having an electrolyte, a plurality of spaced anodes immersed therein and a cathode in contact with the electrolyte, said cell having a longitudinal axis wherein at least one enlarged space between two anodes is provided for the feed of alumina to the cell, said space being transverse to the longitudinal axis of the cell, in a zone of active flow of metal and with favorable cathodic current distribution.

BRIEF DESCRIPTION OF THE DRAWINGS

The nature of the invention will be better understood from the following description taken in connection with the accompanying drawings in which.

DETAILED DESCRIPTION OF PREFERRED EMBODIMENTS

Figure 1:
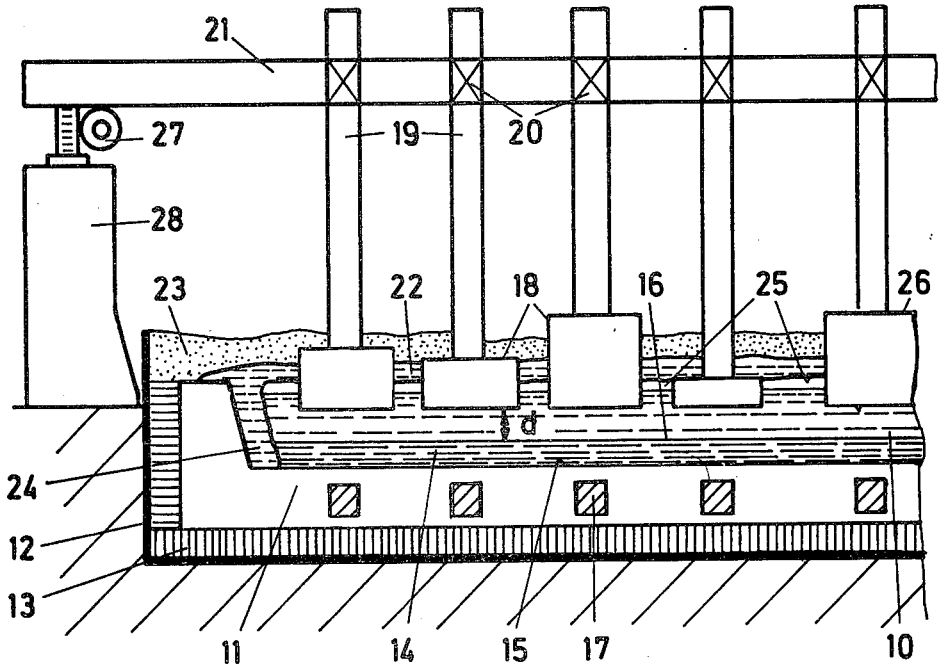
FIG. 1 shows a vertical section through a conventional aluminum electrolytic reduction cell.

The investigations from which the present invention originated showed that it is of advantage to profit from the movement of the metal in the electrolytic cell in order to obtain optimum dissolution of the alumina which is added. On the basis of the electromagnetic fields investigated and measured in centrally fed electrolytic cells representing the present state of the art, it has been found that in most cells the movement of the metal increases the greater the distance from the center of the cell.

On the other hand the manner in which the alumina is added is not negligible in its effect on the movement of the metal. Large additions of alumina at a chosen place can alter or neutralize the stirring of the metal in the cell in that at that place the viscosity of the melt is markedly increased and the part of the cathode concerned almost completely insulated electrically.

Another result of partly insulating the cathode is that localized turbulence can be caused and can lead to undesired rapid erosion of the cathode blocks and/or the carbon side walls.

In spite of knowledge of the movement of the metal and taking account of it, including the incorporation of a number of notable improvements, it has not been possible up to now to achieve a lower part of the lateral ledge at the side walls of centrally fed cells, which insures an acceptable cathode lifetime.

Our investigations have shown that the formation of such a lower part of the lateral ledge is, for example, dependent on one or more of the following factors:

(a) Point of feed of alumina to the cell.
(b) Local cooling of the pot.
(c) Circulation of the metal.
(d) Additions to the molten electrolyte.

The circulation, i.e., the movement of the metal, is strongly dependent on the viscosity of the sludge, so that it is equally dependent on the point at which the alumina is fed to the cell, and the effect of magnetic fields.

In centrally fed cells there is a neutral zone which coincides with the axis of alumina feed to the cell, while the main stream of flow runs along the lateral ledges of the cell. These flow conditions are very unfavorable with respect to eliminating deposits of alumina along the axis of alumina feed to the cell. In fact, they promote erosion of the lateral ledge and deposition of alumina in the corners of the cell.

The localized cooling of the pot occurs normally at the point where alumina is introduced into the cell. Cooling the side wall artificially would be a disadvantage in terms of the electrical energy consumed in the process.

Addition of fluorized salts of the LiF or $MgF_2$ type does not help in the formation of a lower part of the lateral ledge, as the temperature interval between the melt temperature and the solidification temperature is increased.

By selective modification to existing reduction cells the alumina can, in terms of the present invention, be fed after breaking the crust in at least one of the transverse axes in an enlarged space between two anodes which is also known as a feeding space. In a conventional existing electrolytic cell, the removal of a pair of anodes on opposite sides of the longitudinal axis of the cell makes it possible to provide more than one feeding space across the whole width of the cell by shifting the other anodes as necessary, thus allowing transverse feeding of alumina to the cell. This modification of the arrangement of the anodes can be carried out without having to shut down the cell.

In accordance with the present invention, it is possible to break the crust open and feed in alumina at each of the feeding spaces running transverse to the longitudinal axis of the cell.

Because of the manifold possibilities of arranging these feeding spaces, the alumina can be fed in an optimum way into the active zones of metal movement, thus insuring rapid dissolution. Also, the formation of a natural lower part of the lateral ledge at the sides of the cell is favored by transverse feeding. This lower part of the lateral ledge forms under the influence of metal flow in a similar manner to that in the case of cells where conventional side feeding is practiced.

A particularly advantageous feature of the present invention is an arrangement of anodes which provides three feeding spaces extending over the whole breadth of the cell and allows optimum circulation of metal by a more or less asymmetric positioning of alumina feed.

This preferred embodiment has, for example, the following advantages over a centrally fed cell:

(a) Six zones for feeding in alumina.
(b) Increase in the area subject to cooling.
(c) Possibilities to modify the movement of the metal.
(d) Feeding in of the alumina is nearer the side wall (movement of the metal).
(e) Formation of natural lower parts of the lateral ledge.
(f) Reduction in the spacing in the two rows of anodes in the longitudinal direction of the electrolytic cell.

A further advantage of the invention is that no special anodes, anode supports or beams have to be manufactured. In an existing electrolytic cell, e.g., one consuming 140 kA and employing calcined anodes, at least one anode of choice, however, preferably at least a pair of anodes lying on opposite sides of the longitudinal axis of the cell, can be removed. The other anodes can then be moved, according to needs, along the anode beam to form gaps or spaces for transverse feeding of the cell. The number of feeding spaces is preferably equal to 2–3 times the number of anodes removed.

Conventional automatic crust breaking and/or alumina feeding devices can be installed over or in these transverse feeding spaces.

The breaking of the crust can, however, also be carried out with the mobile or motorized crust breaker which is independent of the cell and/or the alumina can be supplied with likewise mobile or motorized loading devices. This has the advantage that considerable investment costs can be saved if such vehicles or devices are already available at the plant.

When the anode effect occurs regularly during the electrolysis process, wooden poles can still be readily pushed in at the transverse feeding spaces which, compared with centrally fed cells, is a much easier task.

All known systems for sealing or encapsulating cells, a measure which is desirable or necessary because of hygiene and environmental factors, are in principle suited to transversely fed cells.

Figure 3:
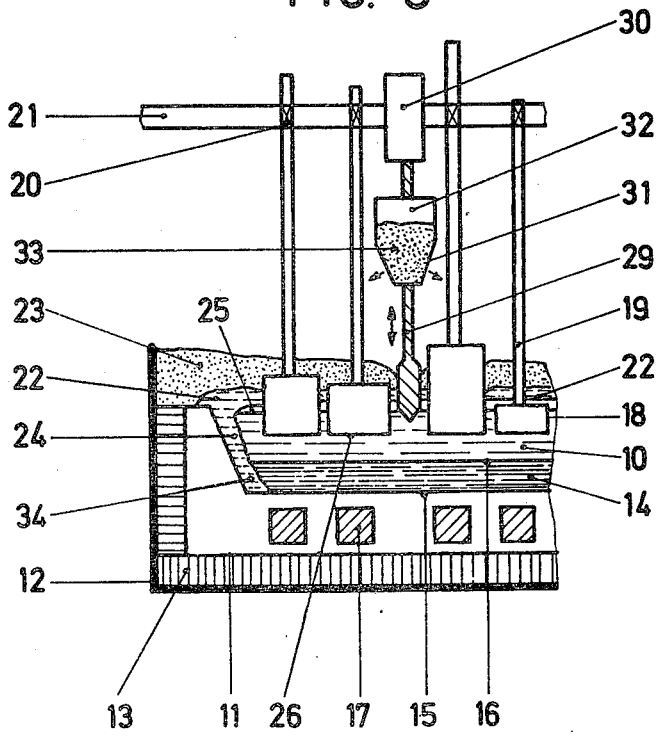
FIG. 3 shows a vertical section along the lines III—III of FIG. 2.
Figure 2:
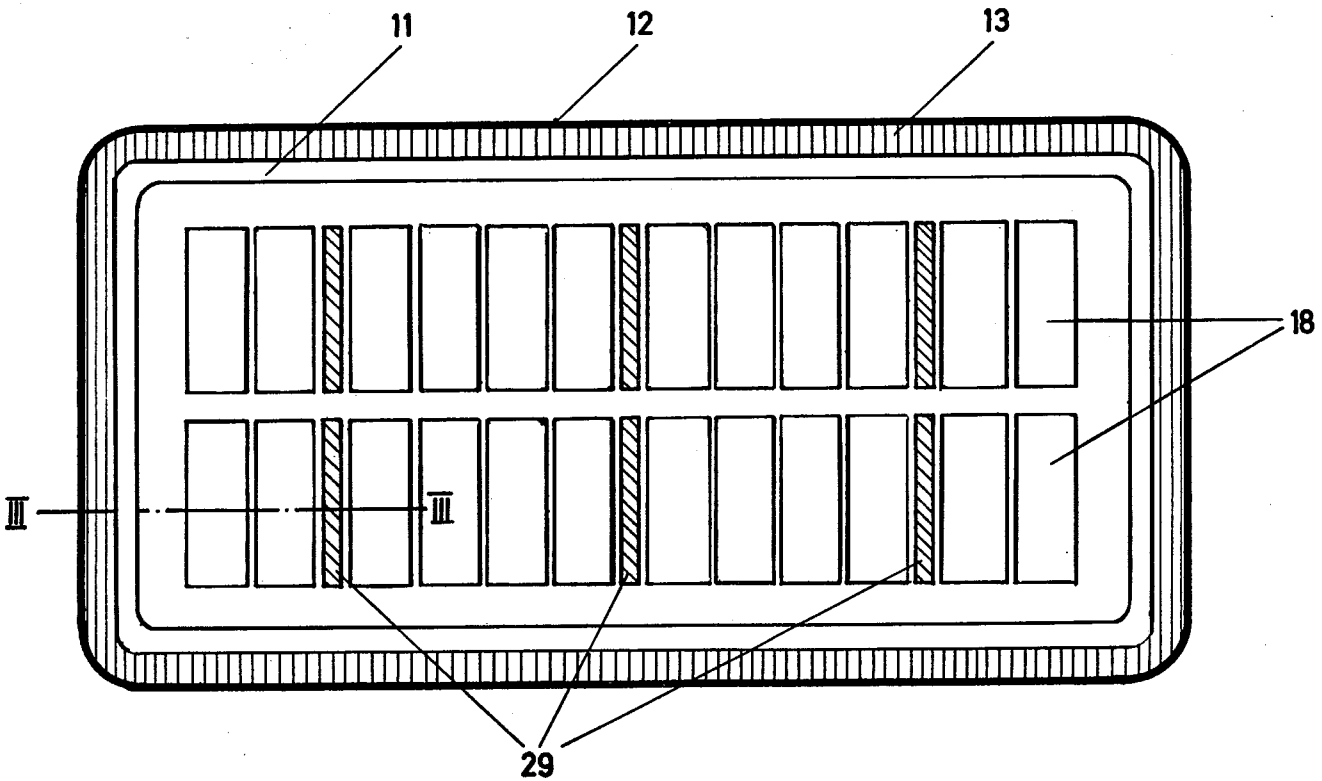
FIG. 2 shows a horizontal section through a modified aluminum electrolytic reduction cell of the present invention.

With the foregoing general description in mind, the invention will now be explained in greater detail with the help of drawings wherein:

FIG. 2 represents a horizontal section through a modified, transversely fed 140 kA cell; and FIG. 3 represents a vertical section along the longitudinal direction of the cell shown in FIG. 2 along the lines III—III.

In the case of the modified, 140 kA cell with calcined anodes shown in FIG. 2, the steel container 12 is lined with a heat resistant, thermally insulating material 13 and carbon 11. The electrolytic cell is fitted with twelve pairs of anodes 18, which have been displaced along the anode beam and regrouped after one pair of anodes was removed from the original cell. As a result, spaces, i.e., feeding spaces, have been formed transverse to the long side of the electrolytic cell. Above, or in each space a crust breaking device 29 is provided together with an associated alumina feeding device which is not shown.

FIG. 3 exhibits a number of features in contrast to the cell of FIG. 1 representing the present state of the art, namely, enlarged feeding space between the second and third anodes to form the feeding space, and a device for breaking open the crust and a feeding device secured to the anode beam in or above the enlarged spaced.

The drive mechanism 30 for breaking open the crust with the chisel 29 which stretches over the whole length of the anode can be manipulated manually or can be controlled automatically. After breaking the crust, the flaps 31 of the alumina container 32 which stretch over the whole length of the anode open and some of the alumina 33 stored in the container is poured over the area of crust which has been broken.

Although the alumina can be fed to the cell only at the transverse positions which have been broken open, the crust 22 of the whole cell is covered with a layer of alumina 23 which insures optimum use of the heat in the cell.

The lower part of the side wall 24 of crust which joins up with the rest of the crust 22 without interruption builds a well formed lower part of the lateral ledge 34 in the transversely fed cells.

In order to make FIG. 3 easier understood, the encapsulation of the electrolytic cell which, from the point of view of construction does not require anything beyond the present state of the art, has been omitted. It is, however, within the scope of the present invention to encapsulate the cell and provide same with a facility for sucking off gases given off in the process.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for the production of aluminum via electrolysis of a molten charge in an electrolytic cell having an electrolyte, a plurality of spaced anodes immersed therein and a cathode in contact with the electrolyte, said cell having a longitudinal axis, wherein the feeding of the cell, including the breaking of the crust of solidified electrolyte and the addition of alumina, is carried out in at least one enlarged, elongated space running transverse to the longitudinal axis of the cell between two anodes in a gap between displaced anodes in a zone of active metal flow where favorable cathodic current distribution exists, thereby obtaining rapid feed dissolution and favoring formation of a lateral ledge of solidified electrolyte.

2. A process according to claim 1 in which, in order to create the feeding spaces, a corresponding number of anodes is removed from an existing cell.

3. A process according to claim 2 in which a number of anodes, which is smaller than the number of spaces to be created, is removed and the remaining anodes are displaced along the anode beam to create the feeding spaces.

4. A process according to claim 1 in which the feeding of the cell takes place by means of mobile devices, which break the crust and/or feed in new alumina and which are separate from and independent of the electrolytic cell.

5. A process according to claim 1 wherein the feeding of the cell is carried out in at least one of said spaces running perpendicular to the longitudinal axis of the cell between two anodes.

6. A process according to claim 1 wherein the feeding of the cell is carried out in an elongated, enlarged feeding space which extends substantially entirely in the space transverse to the longitudinal axis of the cell between two anodes.

7. A process according to claim 1 wherein the feeding of the cell is carried out in an enlarged space extending over the length of the anode.

8. An electrolytic cell for the production of aluminum having an electrolyte, a plurality of spaced anodes adapted to be immersed therein and a cathode adapted to be in contact with the electrolyte, said cell having a longitudinal axis wherein at least one enlarged, elongated space between two anodes is provided in a gap between displaced anodes for the feed of alumina to the cell, including the breaking of the crust of solidified electrolyte, said space being transverse to the longitudinal axis of the cell, in a zone of active flow of metal and with favorable cathodic current distribution, thereby obtaining rapid feed dissolution and favoring formation of a lateral ledge of solidified electrolyte.

9. An electrolytic cell according to claim 8 wherein said anodes are provided in pairs and wherein there is provided an even number of feeding spaces, at least one such space running across the whole width of the cell between two pairs of anodes.

10. An electrolytic cell according to claim 9 in which three feeding spaces are provided over the whole width of the cell providing six zones for feeding in alumina.

11. An electrolytic cell according to claim 8 in which above each space there is provided a device for breaking the crust and/or feeding in alumina.

12. An electrolytic cell according to claim 11 wherein said crust breaking device is automatically controlled.

13. An electrolytic cell according to claim 8 including at least one of said feeding spaces running perpendicular to the longitudinal axis of the cell between two anodes.

14. An electrolytic cell according to claim 8 including at least one elongated, enlarged feeding space which extends substantially entirely in the space transverse to the longitudinal axis of the cell between two anodes.

15. An electrolytic cell according to claim 8 including an enlarged feeding space extending over the length of the anode.

16. An electrolytic cell according to claim 8 including means for storing alumina to be fed to the cell positioned directly over said space.

* * * * *